US008952859B2

(12) United States Patent
Tan

(10) Patent No.: US 8,952,859 B2
(45) Date of Patent: Feb. 10, 2015

(54) COMPACT ANTENNA SYSTEM HAVING FOLDED DIPOLE AND/OR MONOPOLE

(75) Inventor: Mack Tan, Burnaby (CA)

(73) Assignee: NETGEAR, Inc., San Jose, CA (US)

( * ) Notice: Subject to any disclaimer, the term of this patent is extended or adjusted under 35 U.S.C. 154(b) by 196 days.

(21) Appl. No.: 13/536,408

(22) Filed: Jun. 28, 2012

(65) Prior Publication Data

US 2013/0002503 A1 Jan. 3, 2013

Related U.S. Application Data

(60) Provisional application No. 61/503,035, filed on Jun. 30, 2011.

(51) Int. Cl.

| | |
|---|---|
| ***H01Q 9/26*** | (2006.01) |
| ***H01Q 1/24*** | (2006.01) |
| ***H01Q 5/00*** | (2006.01) |
| ***H01Q 21/28*** | (2006.01) |

(52) U.S. Cl.

CPC ..... *H01Q 1/243* (2013.01); *H01Q 5/0051* (2013.01); *H01Q 9/26* (2013.01); *H01Q 21/28* (2013.01)

USPC ..... 343/803; 343/702

(58) Field of Classification Search

CPC ..... H01Q 1/243; H01Q 21/28; H01Q 9/26; H01Q 5/0051

USPC ..... 343/702, 700 MS, 803, 895, 793

See application file for complete search history.

(56) References Cited

U.S. PATENT DOCUMENTS

| | | | | |
|---|---|---|---|---|
| 6,249,255 | B1 * | 6/2001 | Eggleston | 343/702 |
| 2005/0195119 | A1 * | 9/2005 | Gaucher et al. | 343/795 |
| 2007/0069958 | A1 * | 3/2007 | Ozkar | 343/700 MS |
| 2008/0316120 | A1 * | 12/2008 | Hirota et al. | 343/702 |
| 2009/0066603 | A1 * | 3/2009 | Park et al. | 343/834 |
| 2012/0076184 | A1 * | 3/2012 | Tran et al. | 375/222 |
| 2012/0146856 | A1 * | 6/2012 | Tanaka et al. | 343/700 MS |

* cited by examiner

*Primary Examiner* — Hoanganh Le

(74) *Attorney, Agent, or Firm* — Boyle Fredrickson, S.C.

(57) ABSTRACT

An antenna and multi-antenna system are provided. Each antenna of the system is a mirror image and comprises first and second conductive elements each having a first end and a second end portion, the second end portions being capacitively coupled to each other. Each antenna can be operated as a lower-frequency folded dipole having a series capacitive gap which facilitates electrical lengthening of the antenna, or as a higher-frequency monopole antenna having a parasitic element which facilitates improved bandwidth. The antennas' feedpoints may be placed at opposite corners of a ground plane, and separated by a distance which is less than one quarter of an operating wavelength of the dipole but greater than one quarter of an operating wavelength of the monopole. Locating the feedpoints at the ground plane corners facilitates orthogonal polarization of the two antennas at least in dipole mode. The antennas thus provided exhibit good isolation.

15 Claims, 13 Drawing Sheets

COMPACT ANTENNA SYSTEM HAVING FOLDED DIPOLE AND/OR MONOPOLE

FIELD OF THE INVENTION

The present invention pertains in general to antenna systems and in particular to compact antenna systems having at least one dipole antenna, monopole antenna, or dual-band antenna operating as both a dipole and a monopole.

BACKGROUND

Compact antenna systems are desirable for reasons such as portability, cost, and ease of manufacture, and are particularly well-suited for mobile, wireless devices. Interest in compact antenna systems has been further stimulated by the use of higher radio frequencies, for example UHF and higher, which allow for antenna lengths significantly less than 1 centimetre, and by the development of lithographic techniques which allow for antenna systems to be printed directly onto circuit boards or device housings with small form factors at low cost.

However, as the size of portable devices decreases below a quarter of a wavelength of an antenna operating frequency, it becomes challenging to provide for adequate antennas and associated ground planes embedded in the device. For example, a quarter-wavelength monopole antenna may not fit in devices below a certain size, depending on operating frequency. Adequately sized ground planes may also be too large to fit in devices below a certain size. In addition, it is difficult to provide multiple antennas with adequate isolation and/or envelope correlation coefficient in such physically small devices, for example for facilitating antenna diversity or multi-input multi-output (MIMO) communications.

Electrically small antennas (typically defined as antennas having their largest physical dimension no greater than one tenth their operating wavelength) have been proposed and used in a variety of applications, including mobile wireless devices. However, such antennas come with limitations, and it remains difficult to provide an antenna or multi-antenna system which exhibits acceptable performance for a given application, for example as measured by factors such as gain, efficiency, bandwidth, q-factor, antenna isolation, and envelope correlation coefficient.

Therefore there is a need for a compact antenna system that is not subject to one or more limitations of the prior art.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a compact antenna system having a folded dipole and/or a monopole. In accordance with an aspect of the present invention, there is provided an antenna comprising first and second conductive elements, each of the conductive elements having a first end and a second end portion, at least the first end of the first conductive element being operatively coupled to an antenna feedpoint, wherein the second end portions are capacitively coupled to each other.

In accordance with another aspect of the present invention, there is provided a multi-antenna system comprising a pair of the antennas, the pair oriented as minor images of each other with respect to a predetermined axis of symmetry, each antenna of the pair comprising first and second conductive elements, each of the conductive elements having a first end and a second end portion, at least the first end of the first conductive element being operatively coupled to an antenna feedpoint, wherein the second end portions are capacitively coupled to each other.

In accordance with another aspect of the present invention, there is provided an antenna operable in a monopole mode and a dipole mode, the antenna comprising first and second conductive elements, wherein, in the monopole mode, at least a portion of the first element operates as an active monopole element, and wherein, in the dipole mode, at least a portion of the first element operates as a first active dipole element and at least a portion of the second element operates as a second active dipole element.

In accordance with another aspect of the present invention, there is provided a multi-antenna system comprising a pair of the antennas, each of the pair being operatively coupled to a common ground plane, the pair oriented as mirror images of each other, the pair being substantially orthogonally polarized, each antenna of the pair being operable in a monopole mode and a dipole mode, each antenna comprising first and second conductive elements, wherein, in the monopole mode, at least a portion of the first element operates as an active monopole element, and wherein, in the dipole mode, at least a portion of the first element operates as a first active dipole element and at least a portion of the second element operates as a second active dipole element.

In accordance with another aspect of the present invention, there is provided a method of providing one or more antennas, the method comprising: providing each of the one or more antennas as a printed circuit on a flexible substrate, each of the one or more antennas comprising first and second conductive elements, each of the conductive elements having a first end and a second end portion, at least the first end of the first conductive element being operatively coupled to an antenna feedpoint, wherein the second end portions are capacitively coupled to each other; and mounting each of the one or more antennas onto a curved surface.

BRIEF DESCRIPTION OF THE FIGURES

These and other features of the invention will become more apparent in the following detailed description in which reference is made to the appended drawings.

DETAILED DESCRIPTION OF THE INVENTION

Definitions

Figure 1:
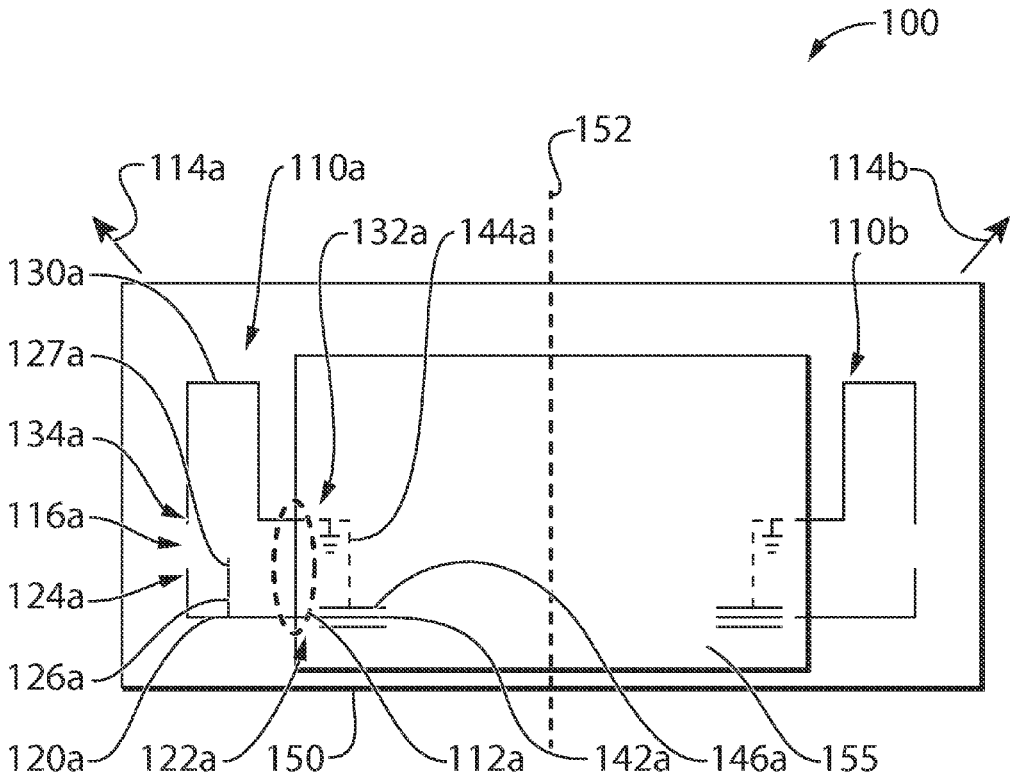
FIG. 1 schematically illustrates a multi-antenna system provided in accordance with an embodiment of the present invention.

The term "antenna" refers to a system of conductive elements, which radiate an electromagnetic field in response to an appropriate alternating voltage and/or current applied to one or more elements of the system, or which produce an alternating voltage and/or current when placed in an appropriate electromagnetic field, or both. An antenna may comprise active elements only, or both active and passive elements. Active elements are conductive elements which are directly coupled to an electrical source and/or sink such as a radiofrequency (RF) front-end, antenna feedpoint, or the like, typically via a transmission line. Passive elements, such as parasitic elements, reflectors, directors, counterpoises, ground plane portions, and the like, may not be directly coupled to an electrical source and/or sink, but these elements nevertheless interact electromagnetically, or electrically (for example capacitively or inductively) with other elements to contribute to functionality of the antenna.

In embodiments of the present invention, passive antenna elements may be described as conductive structures which support antenna operation in one or more capacities. Such capacities can include absorbing and re-radiating electromagnetic radiation from active elements so as to produce a desired radiation pattern, as well as reflecting and/or scattering electromagnetic radiation. Passive elements may also interact electrically (for example capacitively or inductively) with active elements, thereby affecting antenna electrical characteristics. For example, in some cases, passive elements may be used to electrically lengthen or shorten an antenna.

The term "multi-antenna system" refers to a system of plural antennas which can be used cooperatively for communication. Multi-antenna systems may be used to facilitate antenna diversity, MIMO communications, and the like, as would be readily understood by a worker skilled in the art. In antenna diversity, it is typically desirable that different antennas experience different interference environments, for example through spatial diversity, pattern diversity, polarization diversity, or the like.

The term "antenna radiation pattern" is defined as a geometric representation of the relative electric field strength as emitted by a transmitting antenna at different spatial locations. For example, a radiation pattern can be represented pictorially as one or more two-dimensional cross sections of the three-dimensional radiation pattern. Because of the principle of reciprocity, it is known that an antenna has the same radiation pattern when used as a receiving antenna as it does when used as a transmitting antenna. Therefore, the term radiation pattern is understood herein to also apply to a receiving antenna, where it is representative of the relative amount of electromagnetic coupling between the receiving antenna and an electric field at different spatial locations.

The term "polarization", as it pertains to antennas, is defined herein as a spatial orientation of the electric field produced by a transmitting antenna, or alternatively the spatial orientation of electrical and magnetic fields causing substantially maximal resonance of a receiving antenna. For example, in the absence of reflective surfaces, a simple monopole or dipole transmitting antenna radiates an electric field which is oriented parallel to the radiating bodies of the antenna.

The terms "reactance", "resistance", "inductance", and "capacitance" are defined as characteristics of electrical impedance. Structures and components of antennas and supporting systems as described herein may concurrently exhibit not just one but several different types of electrical impedance. It is therefore understood that when the above terms are used herein, it is meant to highlight a property of an electrical structure, without excluding the possibility that other properties may be present.

The terms "ground plane" and "counterpoise" are used to refer to electrical structures supporting electronic elements such as transmission lines and antennas. A ground plane generally refers to a structure which enables operation of an antenna or transmission line by providing an electromagnetic reference having desirable properties such as absorption and re-radiation, reflection, or scattering of electromagnetic radiation over a prespecified frequency range. In a planar structure such as a printed circuit board, a ground plane may possibly comprise a layer of conductive material covering a substantial portion of the planar structure, which may or may not be connected to earth ground. A counterpoise, as generally defined in antenna systems, can be a structure which is used as a substitute for a ground plane, for example having a smaller size than an equivalent ground plane but with a strategically designed structure which enables the counterpoise to effectively emulate such a ground plane. For example, a counterpoise can be regarded as a type of ground plane. A ground plane or portion thereof may be regarded as a passive antenna element, insofar as it interacts with active antenna elements.

As used herein, the term "about" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this invention belongs.

In accordance with an aspect of the present invention, there is provided an antenna comprising first and second, generally elongated, conductive elements. The conductive elements may be wires or printed electrical traces, for example. Each of the first and second conductive elements has a first end and a second end portion. At least the first end of the first conductive element is operatively coupled to an antenna feedpoint. Furthermore, the second end portions of the first and second conductive elements are capacitively coupled to each other. The capacitive coupling of the second end portions may be provided to a degree which facilitates an electrical lengthening of the antenna. Capacitive coupling is generally accomplished by bringing predetermined lengths of the two end portions into predetermined proximity with each other. Capacitive coupling may be varied by varying the proximity between the two end portions, the lengths of the two end portions, or both, as would be readily understood by a worker skilled in the art.

In various embodiments, the first and second conductive elements generally diverge from the feedpoint and then generally converge again toward their ends distal from the feedpoint, without touching at their converging ends. One or both of the conductive elements include meandering sections, stubs, branches, or a combination thereof. General divergence and convergence may correspond to divergence and convergence of the elements on average, that is, when variations in the distance between the elements due to meandering is filtered out. Meandering may be provided and configured to achieve a longer conductor length within a given area, thereby tuning the antenna to a lower frequency than would generally be achieved without such meandering. Stubs, branches, or both, may additionally or alternatively be provided at least in part to achieve fine tuning of bandwidth.

In accordance with embodiments of the invention, the first conductive element further comprises a branched section, which provides a third end of the first conductive element. The branched section may be used to facilitate a dual functionality of the first conductive element, for example one or more branches of the first conductive element may be used to provide a monopole antenna and one or more branch (the same or different branches) may be used to provide a portion of a folded dipole antenna.

In accordance with embodiments of the invention, the antenna is operable in a monopole mode and a folded dipole mode. In the monopole mode, at least a portion of the first element, for example including one or more branches of the branched section, operates as an active monopole element. The second element may operate as a grounded or ungrounded passive monopole element. In the folded dipole mode, at least a portion of the first element operates as a first active dipole element and the second element operates as a second active dipole element. The antenna is operatively coupled to the feedpoint in a manner conducive to operation in both the monopole mode and the dipole mode.

In some embodiments, the antenna is provided within a region having a maximum dimension less than or equal to one quarter of an operating wavelength. This facilitates compactness of the antenna. In some embodiments, one or more of the first and second elements are meandered or turned within this region to facilitate providing a desired physical length and electrically effective length of the antenna elements. For example, the electrically effective length of each of the first and second antenna elements, which generally increases with physical length, can be made to be about one quarter of an operating wavelength of the antenna when operating in the dipole mode.

In some embodiments, the antenna is operatively coupled to a ground plane, and the feedpoint is located proximate to a corner of the ground plane. The ground plane may be substantially rectangular or quasi-rectangular, for example. This configuration may facilitate providing a polarization of the antenna which is angled away from a major axis of the antenna and/or the edges of the ground plane which meet at the corner. Other appropriate ground plane shapes may also be used, provided that they provide the desired functionality as described herein, for example by contributing to a desired angled polarization.

In some embodiments, the ground plane has a maximum dimension less than or equal to one quarter of an operating wavelength. In further embodiments, the maximum dimension is substantially less than one quarter of the operating wavelength. The operating wavelength corresponds, for example, to a center wavelength or other operating wavelength of electromagnetic signals associated with the dipole mode of the antenna. In some embodiments, operating wavelengths of the dipole may be several times longer than operating wavelengths of the monopole.

In accordance with embodiments of the present invention, there is provided an antenna operable in a monopole mode and a dipole mode, the antenna comprising first and second conductive elements, wherein, in the monopole mode, at least a portion of the first element operates as an active monopole element, and wherein, in the dipole mode, at least a portion of the first element operates as a first active dipole element and at least a portion of the second element operates as a second active dipole element. In the monopole mode, the second element may operate as a grounded or ungrounded passive monopole element capacitively coupled to the first element.

In accordance with another aspect of the present invention, there is provided a multi-antenna system comprising a pair of the antennas, each of the pair being generally as described above. The antennas are generally oriented as substantial identical or non-identical minor images of each other with respect to a predetermined axis of symmetry. The multi-antenna system may be used as a diversity antenna system, MIMO antenna system, or the like.

In some embodiments, the antennas are substantially identical mirror images. That is, if one antenna were mirrored with respect to a selected axis, it would become identical to the other antenna. In other embodiments, the antennas are substantially non-identical minor images. That is, if one antenna were mirrored with respect to a selected axis, it would resemble the other antenna in some respects but not others. For non-identical minor images, certain aspects, such as the convex hull of the two antennas' form and the antenna's polarizations, are substantially mirror images of each other. However, other features, such as the size of the antennas, the precise placement and positional details of stubs, meanders, branches, and other antenna features, and the like, may differ between the two antennas. In other words, in some embodiments, the antennas may be non-identical mirror images in that they are mirror images with regard to macro-features but not necessarily mirror images with regard to micro-features. Macro-features may include such features as overall antenna footprint, polarization, and optionally general shape, and the like. Micro-features may include detailed antenna shape or other factors affecting fine-tuning of antenna frequency, bandwidth, and the like.

One case in which non-identical mirror image antennas is applicable is when the two antennas are used for diversity reception, but only one of the antennas is used for transmission on a separate, likely nearby frequency. The antenna which is used for both transmission and reception may thus be physically configured to have a wider bandwidth than the antenna used for reception only.

In some embodiments, each of the pair of antennas of the multi-antenna system may be orthogonally polarized. For example, each antenna may comprise a polarization substantially at 45 degrees relative to the axis of symmetry. As such, in light of the substantial identical or non-identical mirror image configuration, the polarizations of the pair of antennas are made to be substantially orthogonal to each other.

In some embodiments, the antennas are mirror images of each other in that their polarizations are orthogonal to each other, but the antennas may otherwise be physically dissimilar in some or all aspects. Such pairs of antennas may be referred to as being mirror images in polarization. Such pairs of antennas, although potentially physically dissimilar, may be functionally similar, for example in terms of one or more factors such as impedance, effective area, effective aperture, bandwidth, gain, directivity, efficiency, beamwidth, radiation pattern, polarization, and the like.

In embodiments of the present invention, each of the pair of antennas of the multi-antenna system is operatively coupled to a common ground plane. The feedpoints of each of the pair of antennas may be located proximate to opposite corners of the ground plane. This may facilitate the above-described angled polarization of the antennas.

In embodiments of the present invention, the opposite corners of the ground plane of the multi-antenna system are separated by a distance less than or equal to one quarter of an operating wavelength of the antennas. The operating wavelength corresponds, for example, to a center wavelength or other operating wavelength of electromagnetic signals associated with the dipole mode of the antenna.

For multi-antenna systems, an often significant consideration is isolation between antennas. For example, greater antenna isolation or low envelope correlation suggests a greater probability that one antenna will experience an adequate radio environment even if another does not. As would be readily understood by a worker skilled in the art, radio environments may degrade due to excessive noise, signal fading such as multipath fading, and the like.

In embodiments of the present invention, each of the pair of antennas is substantially isolated from the other when operating in the monopole or dipole mode. For example, the antennas may have polarizations substantially orthogonal to each other at least when operated in the dipole mode. In some embodiments, antenna isolation and/or orthogonal polarizations may facilitate providing a substantially low envelope correlation coefficient between antennas, for example of about 0.1. Such an envelope correlation coefficient may be achieved in a predetermined frequency band about the antenna operating frequency, which is generally a narrow band. The envelope correlation coefficient for a wider band may be higher than 0.1, but may still represent a substantial improvement over prior art solutions.

In some embodiments, a double-peaked response may be used to provide for wider bandwidth of the multi-antenna system, as would be readily understood by a worker skilled in the art. In some such embodiments, the envelope correlation coefficient achieved may be about 0.2 for a predetermined band about the antenna operating frequency. The envelope correlation coefficient for a wider predetermined band about the antenna operating frequency may be about 0.35, wherein this wider predetermined band substantially represents the utilized bandwidth of the antennas.

In some embodiments, an antenna or a system of antennas is provided in a substantially planar configuration, for example as a single-layer or multi-layer printed circuit. In some embodiments, the antenna is provided on a single-layer or multi-layer flexible printed circuit. The flexible printed circuit may then be applied to a curved inner and/or outer surface, such as a device housing. The flexible printed circuit may wrap around a portion of the surface. Optionally, the flexible printed circuit may comprise a transparent plastic substrate, and may be affixed to the surface using a suitable adhesive, such as glue. An electrically insulating layer may be formed over one or both sides of the flexible printed circuit.

In some embodiments, curving of the flexible planar antenna, for example by applying to or wrapping around a curved surface, may affect operational aspects of the antenna, and this may be accounted for in antenna design, orientation, and surface curvature. For example, curving of a planar antenna may affect its polarization. As another example, in some cases, curving of a planar antenna may potentially affect capacitive coupling between the first conductive element and the second conductive element. In some embodiments, the curving of a planar antenna is made to be sufficiently gentle that the antenna at least qualitatively resembles its non-curved counterpart. In some embodiments, the antenna may be designed to operate with a desired set of characteristics when curved in a predetermined manner, and curving may thus be configured to facilitate the antenna's operation.

In some embodiments, the potentially curved surface on which an antenna is placed, or alternatively the shape of a cavity within which an antenna is placed, corresponds to a desired package shape for a wireless device. Thus, shape constraints for the antenna may correspond to a requirement that the antenna fits inside the device package. Concurrently, the package shape may be selected at least in part in order to accommodate an adequate antenna. The design process for the antenna is typically based in part on the desired operating frequency. In some embodiments, the design process starts with an antenna length required for operation at the operating frequency, and shortening techniques and folding techniques are applied to cause the antenna to fit within a desired area or volume. The design may be simulated by specialized software, optimized and then prototyped and tested. Further refinements may be made as necessary, including dealing with adverse coupling and interference with nearby structures and circuits.

In some embodiments, the antennas may be regarded as three-dimensional antennas. In further embodiments the three-dimensional antennas comprise substantially planar bodies curved into a three-dimensional configuration. Such three-dimensional antennas may be achieved, for example, by curving one or more flexible printed circuits over a substrate with a predetermined shape. Other means for providing three-dimensional configurations of electrical conductors to form an antenna may also be employed, as would be readily understood by a worker skilled in the art. In some embodiments, a mirror image of a three-dimensional antenna may be regarded as a stack of minor images of two-dimensional "slices" of the three-dimensional antenna.

The invention will now be described with reference to specific examples. It will be understood that the following examples are intended to describe embodiments of the invention and are not intended to limit the invention in any way.

FIG. 1 schematically illustrates a multi-antenna system 100 provided in accordance with an embodiment of the present invention. The system 100 comprises a first antenna 110*a* and a second antenna 110*b* on opposite sides of a housing 150. The housing 150 may comprise a ground plane 155, electronic components of an associated wireless device, and the like.

Electronic components of a wireless device provided in the housing 150 may include RF electronics and transmission lines for coupling to the antennas 110*a* and 110*b*, as well as interface electronics for sending and/or receiving signals via the RF electronics, one or more processors, memory, user interfaces, or the like, as would be readily understood by a worker skilled in the art. In one embodiment, the wireless device is a wireless hotspot, for example configured to communicate wirelessly via an IEEE 802.11 series protocol or other wireless protocol.

As illustrated, the antennas 110*a* and 110*b* are substantially mirror images of each other, relative to an axis of symmetry 152 running substantially through the middle of the housing 150 and parallel to a major axis of the antennas. Each antenna 110*a* and 110*b* may be substantially two-dimensional, for example as provided by a relatively thin layer of copper or other conductor supported by a flat or curved surface portion of the housing 150, or patterned onto a circuit board within the housing 150.

The antenna 110*a* comprises a first conductive element 120*a* and a second conductive element 130*a*. First ends 122*a* and 132*a* of the first and second conductive elements are coupled to an antenna feedpoint and/or ground plane. For example, as illustrated, first ends 122*a* and 132*a* are substantially proximate to each other, with the first end 122*a* of the first conductive element being connected to an ungrounded conductor 142*a* of a transmission line, and the first end 132*a* of the second conductive element being connected to a grounded conductor 146*a* of the same transmission line, or to a ground point 144*a*, closely associated with the grounded conductor. The transmission line may be a stripline, microstrip, or coaxial transmission line, for example. Alternatively, the first end 132*a* of the second conductive element may be connected to the ungrounded conductor 142*a* and the first end 122*a* of the first conductive element may be connected to the grounded conductor 146*a* or associated ground point 144*a*. In the above configurations, the first end of the conductive element which is connected to the grounded conductor of the transmission line (end 132*a* of the second conductive element as illustrated) acts as a grounded passive (parasitic) monopole element when the antenna 110*a* is operated in a monopole mode.

As yet another alternative, the first ends 122*a* and 132*a* of the first and second conductive elements may be connected to different ungrounded conductors of a differential transmission line. As would be readily understood by a worker skilled in the art, this may substantially change the antenna characteristics, and may require re-tuning of the antenna, for example by adjusting antenna element lengths, capacitance, or the like.

As also illustrated, second end portions 124*a* and 134*a* of the first and second conductive elements are proximate and capacitively coupled to each other across a gap 116*a*. The capacitive coupling facilitates an electrical lengthening of the antenna in at least one mode. That is, it provides for an antenna which acts electrically as if it has a greater length than is actually physically provided by the elements. As would be readily understood by a worker skilled in the art, this facilitates providing a way to reduce antenna size substantially without a corresponding change in characteristics such as impedance and operating frequency.

In embodiments of the present invention, the electrical lengthening is due at least in part to a phase shift, such as a 180 degree phase shift of voltage in the signal induced by and/or across the capacitive gap. As would be readily understood by a worker skilled in the art, capacitors in a circuit induce substantially frequency-dependent phase shifts in sinusoidal and other signals in the circuit. Accordingly, this electrical lengthening may be characterized as a virtual electrical lengthening.

The capacitive coupling of the second end portions 124*a* and 134*a* may be provided, for example, by providing predetermined lengths of conductors of the second end portions 124*a* and 134*a* to be substantially parallel to each other and separated by a predetermined distance. The parallel sections of conductors may be straight, curved, or meandering in a parallel pattern, for example. A capacitance of the capacitive coupling can be varied by varying the length of conductors which are proximate to each other, the distance between the proximate lengths of conductors, or a combination thereof, as would be readily understood by a worker skilled in the art. Varying the capacitance may thus vary an electrical length of the antenna when operating in one or more modes.

As further illustrated in FIG. 1, a feedpoint 112*a* of the antenna 110*a* is generally located at the interface between the antenna's conductive elements 120*a* and 130*a* and the transmission line associated with the conductor pair 142*a* and 146*a*. In embodiments of the present invention, the feedpoint 112*a* is located substantially at or near a corner of a ground plane 155 in the housing 150. This configuration may result in an interaction between the ground plane 155 and the antenna 110*a* which influences a polarization of the antenna 110*a* to be oriented at an angle relative to a major axis of the antenna 110*a*. For example, a substantially linear polarization of the antenna 110*a* when operating in at least the dipole mode may be substantially in a direction 114*a* which is at about 45 degrees relative to the major axis of the antenna 110*a* and a corresponding edge of the ground plane 155. Alternatively, the direction 114*a* may be oriented away from the ground plane 155 and the major axis of the antenna 110*a* at another oblique angle, which may depend for example on the topography of the antenna 110*a* and the dimensions and shape of the ground plane 155.

In embodiments of the present invention, the antenna 110*a* is operable in a dipole mode as a folded dipole antenna comprising a gap 116*a* between two ends 124*a* and 134*a* of the two conductive elements 120*a* and 130*a*, the two ends 124*a* and 134*a* distal from the antenna feedpoint. In the dipole mode, the antenna feedpoint comprises the two proximate first ends 122*a* and 132*a* of the two conductive elements 120*a* and 130*a*. The gap 116*a* may provide a capacitance which facilitates an electrical lengthening of the antenna 110*a* when operating in the dipole mode. In embodiments of the present invention, the electrically effective length of the folded dipole antenna is about half of an operating wavelength of the antenna. The physical length may generally be less than the electrically effective length, for example due to the capacitive gap.

For example, for an operating frequency of 700 MHz in air or vacuum, the operating wavelength would be about 428 mm, and the combined electrically effective length of the two conductive elements 120*a* and 130*a* (along the conductive element path) may be half of this, or about 214 mm. This is in contrast to a standard folded dipole, which would generally have an electrically effective length of about one operating wavelength, or 428 mm. In embodiments of the present technology therefore, the gap 116*a* facilitates substantial shortening of the length of the dipole, for example the physical length and/or required electrically effective length, thereby facilitating compact antenna design. For example the combined length of the two conductive elements 120*a* and 130*a* may be reduced from one operating wavelength to about half of the operating wavelength. The physical length of each of the conductive elements 120*a* and 130*a* may be more or less than a quarter of an operating wavelength, that is about 107 mm in the present example.

In embodiments of the present invention, the antenna 110*a* is operable in a monopole mode as a monopole antenna adjacent to a ground plane 155 and with a grounded parasitic element. In some embodiments of the monopole mode, the antenna feedpoint comprises a first end 122*a* of a first conductive element 120*a*, fed by a conductor 142*a* of a transmission line. The other transmission line conductor 146*a* may be grounded. The first conductive element 120*a* is coupled, for example capacitively and/or electromagnetically, to a grounded conductive element 130*a*, which operates as a passive, for example parasitic, element. In embodiments of the present invention, the first conductive element 120*a* comprises a branched section, which provides for a stub portion 126*a* which terminates in a third end 127*a* of the first conductive element 120*a*. The combination of the part of the first conductive element 120*a* ending at 124*a* and the stub portion 126*a* operates as a "J-type" monopole antenna. The stub portion may be tuned, for example by adjustment of the length thereof, to facilitate operation at a desired operating frequency in the monopole mode. In embodiments of the present technology, the stub portion length may be less than about ¼ of the monopole mode operating wavelength, which may be substantially less than the dipole mode operating wavelength. In some embodiments, the stub portion may also be tuned by introducing parasitic elements, series capacitance, or the like. In embodiments of the present technology, the stub serves to extend the bandwidth of the antenna in at least the monopole mode. In some embodiments the stub may face in the opposite direction from that shown in FIG. 1.

In embodiments of the present invention, the dipole mode corresponds to a relatively low operating frequency compared to the monopole mode. For example, the dipole mode may correspond to an operating frequency in about the 700 MHz range, whereas the monopole mode may correspond to an operating frequency in about the 2 GHz range. The operating frequency may be a center frequency and/or carrier frequency, for example. Other operating frequencies may also be used, as would be readily understood by a worker skilled in the art. For example, at least one mode of operation may correspond to an operating frequency in an ISM band, a VHF, UHF or microwave frequency, or a lower or higher frequency or range of frequencies. A center operating frequency may correspond to a fundamental resonant frequency of the antenna or a higher harmonic. Non-resonant frequencies may also be used, provided adequate measures are taken to address impedance issues, as would be readily understood by a worker skilled in the art.

In embodiments of the present invention, the monopole mode corresponds to an operating frequency which is about two to three times higher than the dipole mode. In such embodiments, a first set of portions of the antenna may be configured for resonance in the dipole mode, while a second set of portions of the antenna may be configured for resonance in the monopole mode. The first and second portions may be at least partially overlapping. In such embodiments, the first set of portions may generally be longer than the second set, due to the operating wavelengths in the dipole mode being between two and three times higher than the operating wavelengths in the monopole mode. Furthermore, the first set of portions may be configured to resonate at a second, third, or higher harmonic of the operating frequency when in the monopole mode. This may be made possible by a combination of frequency selection and length adjustment of the first set of portions. This resonance may facilitate improved communication bandwidth in the monopole mode, as would be readily understood by a worker skilled in the art.

In embodiments of the present invention, operation in the dipole mode reduces or even eliminates a requirement for a large ground plane 155 relative to the operating wavelength of the dipole antenna, since the two conductive bodies 120*a* and 130*a* operate in a complementary manner. This is due at least in part to the fact that dipole antennas do not generally require a ground plane for operation. Since operating wavelength is inversely proportional to operating frequency, when the dipole mode corresponds to a relatively low operating frequency compared to the monopole mode, the size of the ground plane 155 can advantageously be reduced, since it is only constrained by the monopole mode, which does not require as large a ground plane due to its higher operating frequency and smaller operating wavelength. However, the ground plane 155 may still operate as a passive element in the dipole mode, for example reflecting and/or directing electromagnetic radiation and contributing to an angled polarization in this mode. In embodiments of the present invention, the ground plane 155 is configured to be at least one quarter of an operating wavelength of the monopole mode, thereby providing sufficient surface area to act as an adequate ground counterpoise in the monopole mode.

FIG. 1 further illustrates a second antenna 110*b* which is generally similar to, but substantially a mirror image of, the antenna 110*a*. For clarity, the second antenna 110*b* is not described in detail, but it generally comprises the same components as the antenna 110*a* and may also be operated in both a monopole mode and a dipole mode. As illustrated, the first and second antennas 110*a* and 110*b* may be provided on opposite edges, and further at opposite corners, of the ground plane 155. When the two antennas 110*a* and 110*b* are concurrently operated in dipole mode, the polarization 114*a* of the first antenna 110*a* may be substantially orthogonal to the minor-image polarization 114*b* of the second antenna 110*b*, thereby facilitating isolation between the two antennas. In some embodiments, the antenna isolation may facilitate an envelope correlation coefficient between the two antennas of about or below 0.1. This represents an improvement over more standard designs for monopole antennas within a similar volume, which typically results in an envelope correlation coefficient of about 0.8. Such a low envelope correlation coefficient may be used to facilitate antenna diversity and MIMO communications, as would be readily understood by a worker skilled in the art.

Figure 3A:
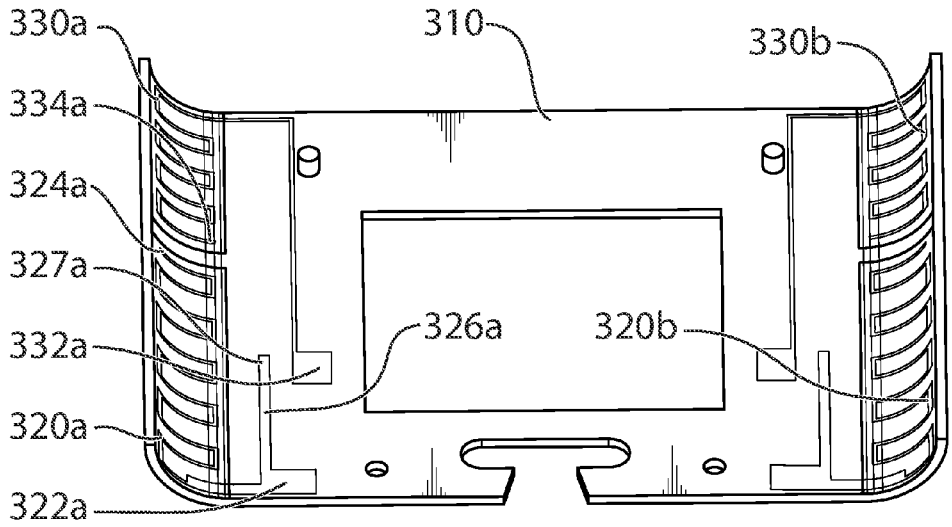
FIGS. 3A and 3B illustrate front and rear views, respectively, of a mobile device housing comprising a multi-antenna system in accordance with an embodiment of the present invention.
Figure 3B:
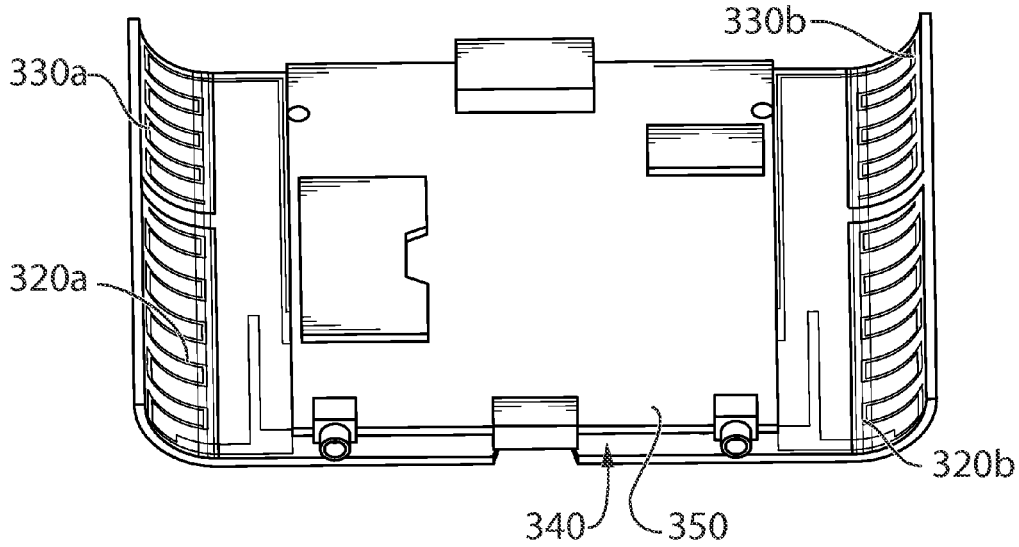

In embodiments of the present invention, isolation between two antennas of the multi-antenna system, when operating in the dipole mode, may be facilitated at least in part by polarization diversity, for example as described above. Isolation between the two antennas may additionally or alternatively be facilitated by independence of ground current flows. For example, when one side of each dipole antenna feedpoint is grounded, ground currents will generally flow in separate grounding branches for each dipole, which are independent for each antenna. For example, the separate grounding branches may comprise grounded conductive bodies such as bodies 130*a* and 130*b* as illustrated in FIG. 1, or bodies 330*a* and 330*b*, as illustrated in FIGS. 3A and 3B. In some embodiments, antenna isolation in the dipole mode may be improved by about 4 dB, relative to the monopole mode, due at least in part to this differential ground current flow. In contrast, when both antennas operate in the monopole mode, ground currents may intermix in the common ground plane, resulting in a reduction in isolation, although isolation may generally improve with the size of the ground plane.

In embodiments of the present invention, multi-antenna operation in the dipole mode may correspond to an efficiency improvement of about 1.5 dB when compared to operation in the monopole mode. Antenna efficiency generally measures electrical losses of an antenna when operating near a given frequency, as would be readily understood by a worker skilled in the art. In some embodiments, the improved efficiency of the dipole mode is due in part to increased isolation of the antennas and decreased loading of one antenna on another. The improved efficiency in the dipole mode combined with the 4 dB improved measured isolation may contribute to an effective isolation improvement between the two dipole antennas of about 7 dB, relative to a monopole configured for operation in a similar band, for example the 700 MHz band. For example, starting from a base case where the improvements described in the present technology are not used, each antenna might have an efficiency of −4 dB and the measured isolation might be 3 dB. This results in an effective isolation of (3 dB−4 dB−4 dB=−5 dB) that means the two antennas have 5 dB of coupling that is undesirable. The present technology, as described herein, may be used for adjustment of this base case for providing an efficiency of each antenna of about −2.5 dB (representing a 1.5 dB improvement over the base case) and with the measured isolation between antennas of about 7 dB. The effective antenna isolation provided in accordance with this embodiment of the present technology is then calculated as 7 dB−2.5 dB−2.5 dB=2 dB. This can represent a significant improvement over the base case.

In embodiments of the present invention, multi-antenna operation in the monopole mode results in relatively high bandwidth, antenna efficiency, antenna isolation, and low envelope correlation coefficient due at least in part to the large size of the ground plane separating the two antennas, relative to the operating wavelength in the monopole mode.

Figure 2:
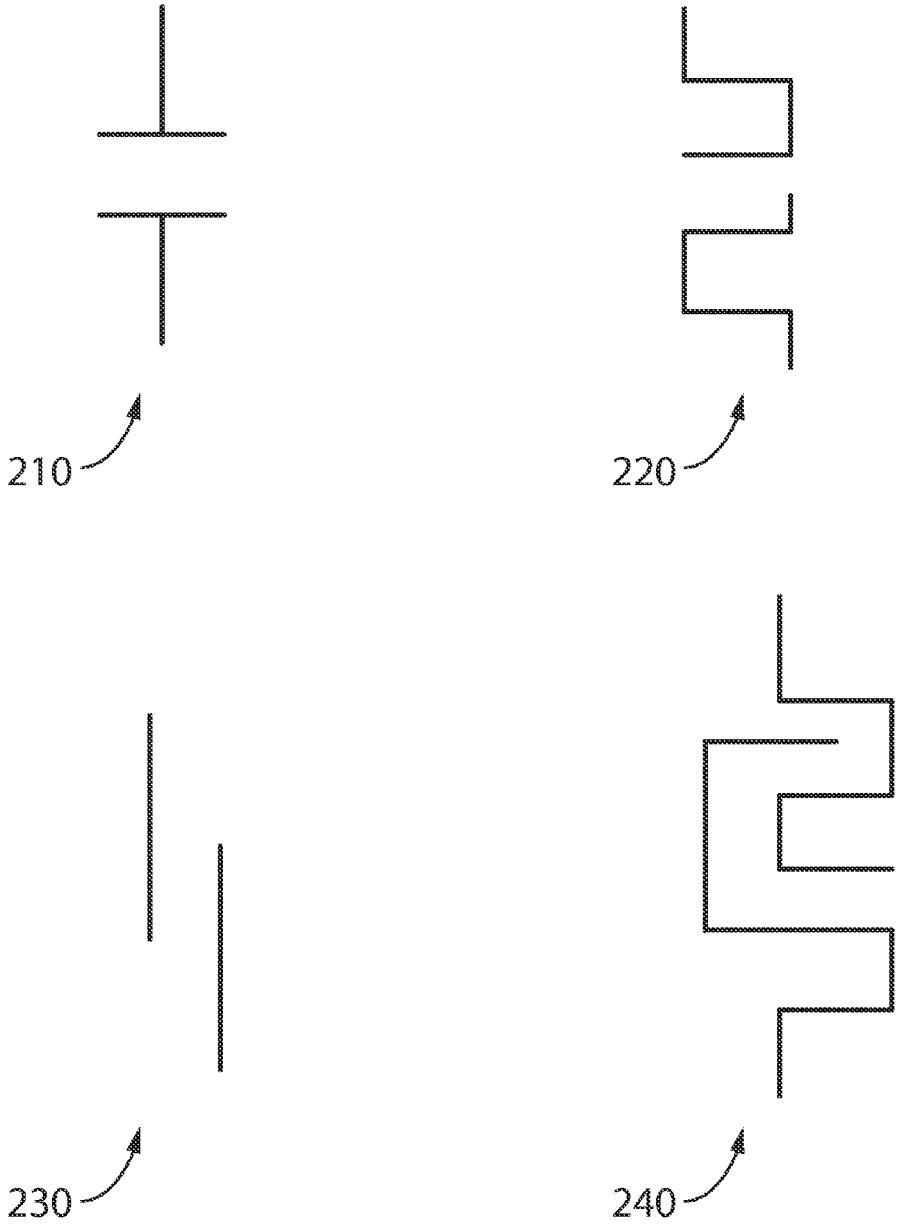
FIG. 2 illustrates different exemplary arrangements corresponding to potential capacitive couplings between conductive antenna elements, in accordance with embodiments of the present invention.

FIG. 2 illustrates different exemplary arrangements corresponding to potential capacitive couplings between conductive antenna elements, in accordance with embodiments of the present invention. Other arrangements may also be used, as would be readily understood by a worker skilled in the art. Arrangement 210 comprises bifurcated conductive elements to obtain an arrangement similar to parallel-plate capacitors. Arrangement 220 comprises meandering conductive elements having a parallel, spaced-apart portion. Arrangement 230 comprises substantially straight conductive elements having a parallel, spaced-apart portion. Arrangement 240 comprises meandering conductive elements having a parallel, that is substantially equidistant, and meandering spaced-apart portion.

FIGS. 3A and 3B illustrate a mobile device comprising a multi-antenna system in accordance with an embodiment of the present invention. The multi-antenna system comprises a housing 310 supporting four substantially flattened conductive elements 320*a*, 330*a*, 320*b*, and 330*b*. The conductive element 320*a* comprises a feedpoint end 322*a*, a meandering section terminating at another end 324*a*, and a branched stub section 326*a* terminating at a third end 327*a*. The conductive element 330*a* comprises an end 332*a*, which may be grounded and/or which may correspond to a portion of an antenna feedpoint. The conductive elements 320*a* and 330*a* correspond to a first antenna. The conductive element 330*a* further comprises a meandering section terminating at another end 334*a*. The ends 324*a* and 334*a* of the conductive elements 320*a* and 330*a* may be proximate and capacitively coupled.

The meandering sections of the conductive elements 320*a* and 330*a* comprise elongated conductors, each folding back on itself via plural bends and turns, thereby facilitating providing a greater physical length of the conductive elements 320*a* and 330*a* in a compact area or volume. The greater physical length may in turn correspond to a greater electrical length of the antenna. In embodiments of the present invention, the total length along the path of the conductive elements 320*a* and 330*a* from end 322*a* to end 332*a* and excluding the stub section 326*a* is configured to provide an electrically effective length of about one half of an operating wavelength of the first antenna when operated in dipole mode. As described herein, the length of the stub section 326*a* may be adjusted for tuning an operating frequency of the monopole mode and/or antenna bandwidth in the monopole mode.

The first antenna may be operated as a folded dipole antenna with the two conductive elements 320*a* and 330*a* corresponding to capacitively coupled portions of a folded dipole with series capacitive element, the first antenna comprising a feedpoint corresponding to the proximate ends 322*a* and 332*a*. The first antenna may be operated as a monopole, with the conductive element 330*a* corresponding to a passive and/or resonant antenna element which may facilitate an increased bandwidth of the monopole. The stub portion 326*a* also facilitates an increased bandwidth of the monopole.

The conductive elements 320*b* and 330*b* may be substantial minor images of the conductive elements 320*a*, and 330*a*, and be similarly and concurrently operated in monopole or dipole mode, via its own feedpoints, to provide a multi-antenna system comprising a second antenna which is substantially isolated from the first antenna. The two antennas may be separated by a distance which is less than one quarter of an operating wavelength of the antennas when operating in dipole mode, but greater than or equal to one quarter of an operating wavelength of the antennas when operating in the monopole mode.

Referring still to FIGS. 3A and 3B, a printed circuit board 340 may be provided having a ground plane 350 along with other circuitry and components of the mobile device, such as RF electronics, transmission lines, digital signal processing electronics, and other processing components, user interface components, and the like. As illustrated, the ground plane is generally square or rectangular, with the feed points of the first and second antennas situated near opposite corners of the ground plane. This facilitates a desired interaction between the antennas and the ground plane, which may affect antenna aspects such as isolation, polarization, and the like, as described herein. First and second transmission lines are operatively coupled to the first and second antenna feedpoints, respectively, and are routed on the circuit board, adjacent to and/or incorporating the ground plane 350.

Figure 4A:
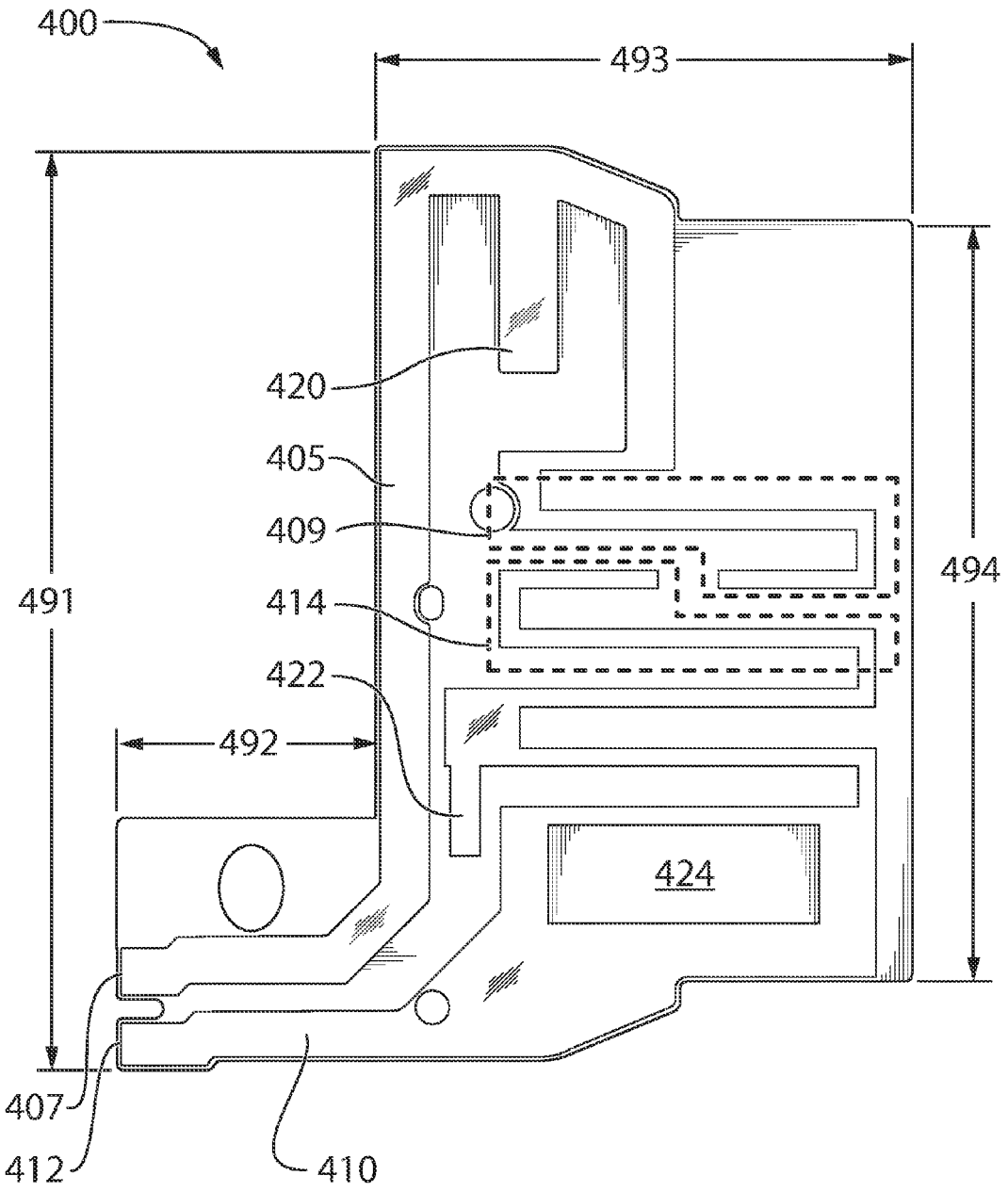
FIG. 4A illustrates the planar form of an antenna provided in accordance with an embodiment of the present invention.

FIG. 4A illustrates the planar form of an antenna 400 provided in accordance with embodiments of the invention. The antenna 400 may be provided in its planar configuration as electrically conductive elements printed on a flexible substrate, and subsequently the antenna 400 may be curved into a three-dimensional configuration. The antenna 400 comprises a first conductive element 405 and a second conductive element 410. The first and second conductive elements have first ends 407 and 412, respectively, which are proximate to each other so as to provide an antenna feedpoint. The first and second conductive elements also have second end portions 409 and 414, respectively, which are capacitively coupled to each other, for example to provide for electrical antenna lengthening.

Select further features of the antenna 400 will now be described. Starting from either endpoint, the first conductive element 405 and the second conductive element 410 generally diverge from each other. Each of the first conductive element 405 and the second conductive element 410 comprise meandering portions, which include the second end portions 409 and 414, respectively, as well as portions adjacent thereto. The meandering portions may provide for greater electrical antenna length within a given area limit.

The antenna 400 further comprises branches or stubs 420 and 422, and an aperture 424 defined by the second conductive element. These features may facilitate tuning of the antenna resonant frequency, bandwidth, or both, for example. The stub 420 faciliates an increase in bandwidth of the low, for example 800 MHz, band, which may be the frequency band corresponding to operation of the antenna in the dipole mode. The stub 422 facilitates an increase in bandwidth of the high band monopole on the low frequency end thereof. The stub 422 may further facilitate an improved impedance match of the antenna. The aperture 424 facilitates an increase in bandwidth of the antenna by creating more and different electrical paths. This may be regarded as similar to using a Litz wire conductor or thicker antenna element rod for increasing the bandwidth.

The conductive element 410 may be configured to operate as a monopole antenna active element in a monopole mode.

The antenna 400 illustrated in FIG. 4A may be configured as a main antenna for signal transmission and reception at about 800 MHz (in one mode) by dimensioning it as follows. Illustrated dimension 491 is about 46.75 mm, dimension 492 is about 13.06 mm, dimension 493 is about 27 mm, and dimension 494 is about 38.5 mm. Other features of the antenna, such as meander lengths and stubs, are illustrated to scale in proportion to these dimensions. It is noted that the antenna 400 is provided within a region having maximum dimension 491 which is less than one quarter of the operating wavelength at 800 MHz, (i.e. 46.75 mm is less than 93.8 mm). In fact, the maximum dimension 491 of the rectangular region containing the antenna 400 is about one eighth of the operating wavelength at 800 MHz.

Figure 4B:
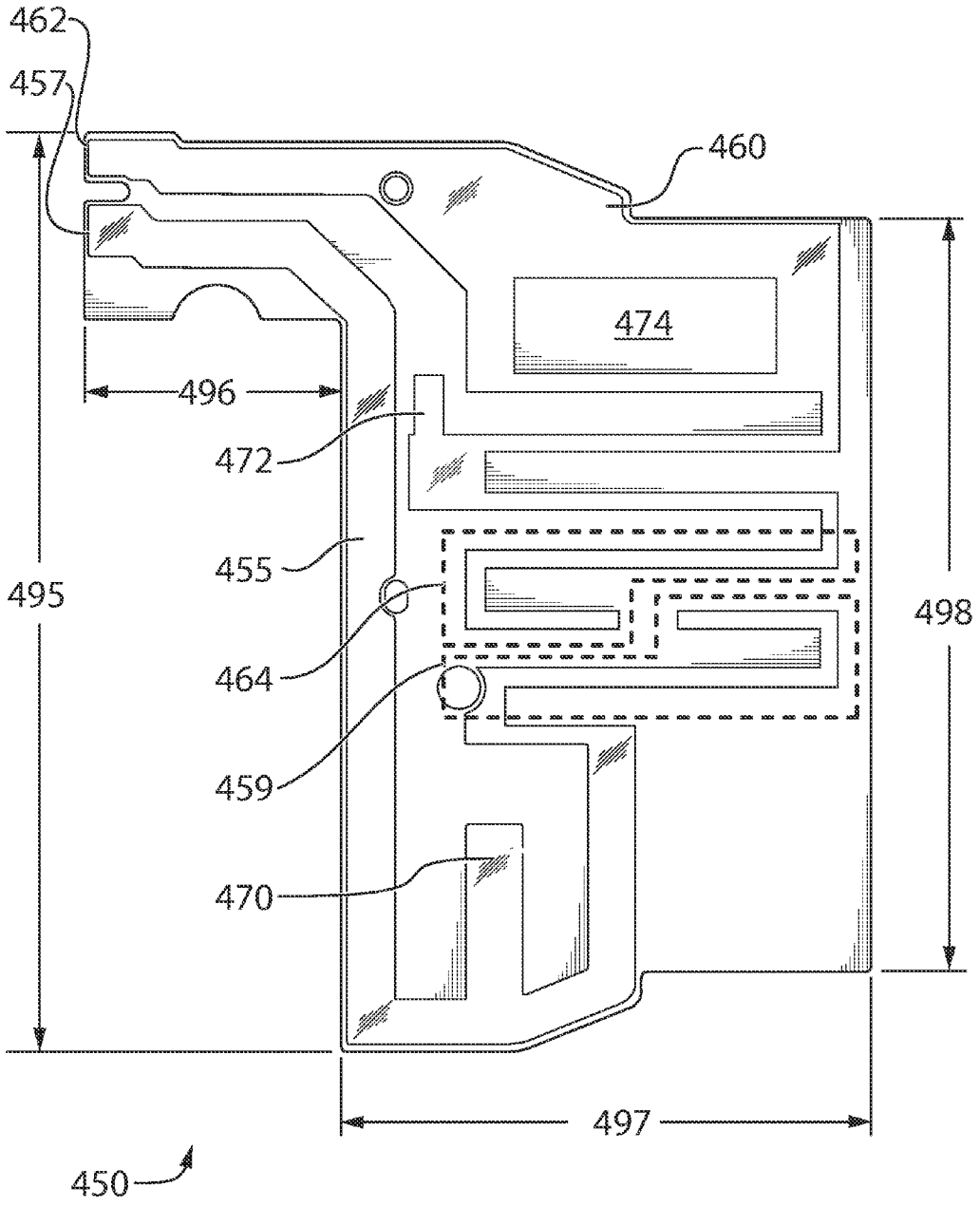
FIG. 4B illustrates the planar form of another antenna, which is a non-identical minor image of the antenna of FIG. 4A, in accordance with an embodiment of the present invention.

FIG. 4B illustrates the planar form of an antenna 450 provided in accordance with embodiments of the invention, which may subsequently be curved into a three-dimensional configuration. The antenna 450 comprises a first conductive element 455 and a second conductive element 460. The first and second conductive elements have first ends 457 and 462, respectively, which are proximate to each other so as to provide an antenna feedpoint. The first and second conductive elements also have second end portions 459 and 464, respectively, which are capacitively coupled to each other.

Starting from either endpoint, the first conductive element 455 and the second conductive element 460 generally diverge from each other. Each of the first conductive element 455 and the second conductive element 460 comprise meandering portions, which include the second end portions 459 and 464, respectively, as well as portions adjacent thereto. The antenna 450 further comprises branches or stubs 470 and 472, and an aperture 474 defined by the second conductive element.

The antenna 450 illustrated in FIG. 4B may be configured as a diversity antenna for signal reception in cooperation with the antenna 400 at about 800 MHz by dimensioning it as follows. Illustrated dimension 495 is about 46.8 mm, dimension 496 is about 13.14 mm, dimension 497 is about 27.04 mm, and dimension 498 is about 38.5 mm. Other features of the antenna, such as meander lengths and stubs, are illustrated to scale in proportion to these dimensions. The antenna 450 is a non-identical mirror image of the antenna 400.

Figure 4C:
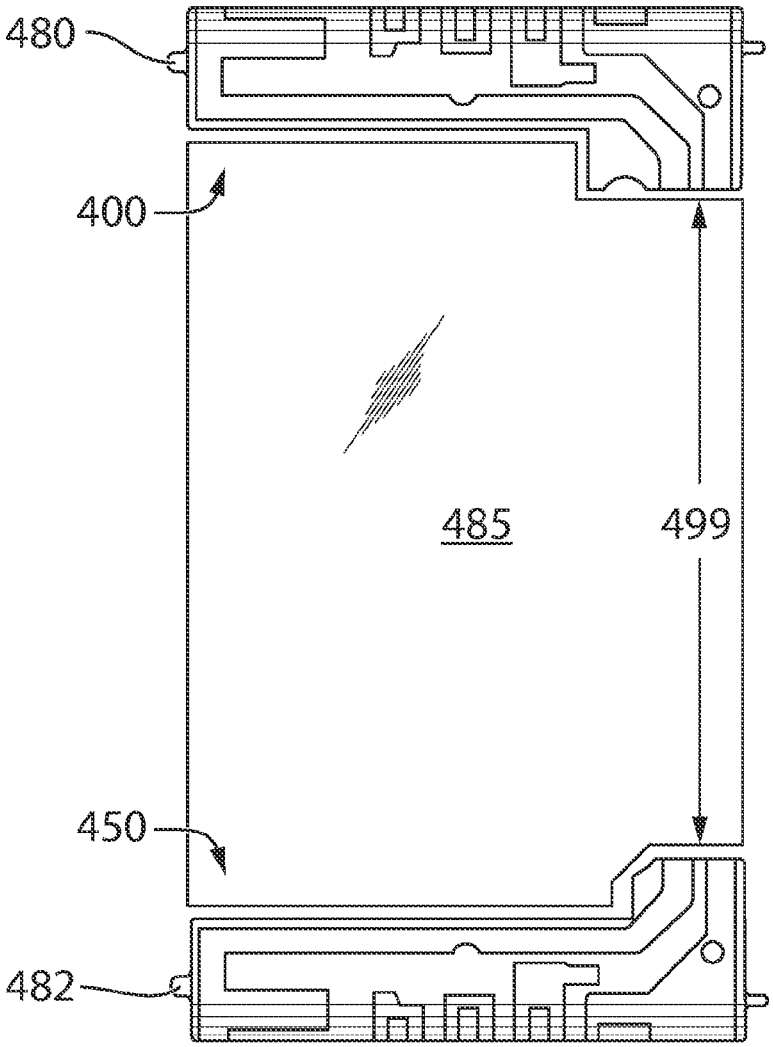
FIGS. 4C and 4D illustrate the antennas of FIGS. 4A and 4B spaced apart and mounted on a curved surface, in accordance with an embodiment of the present invention.
Figure 4D:
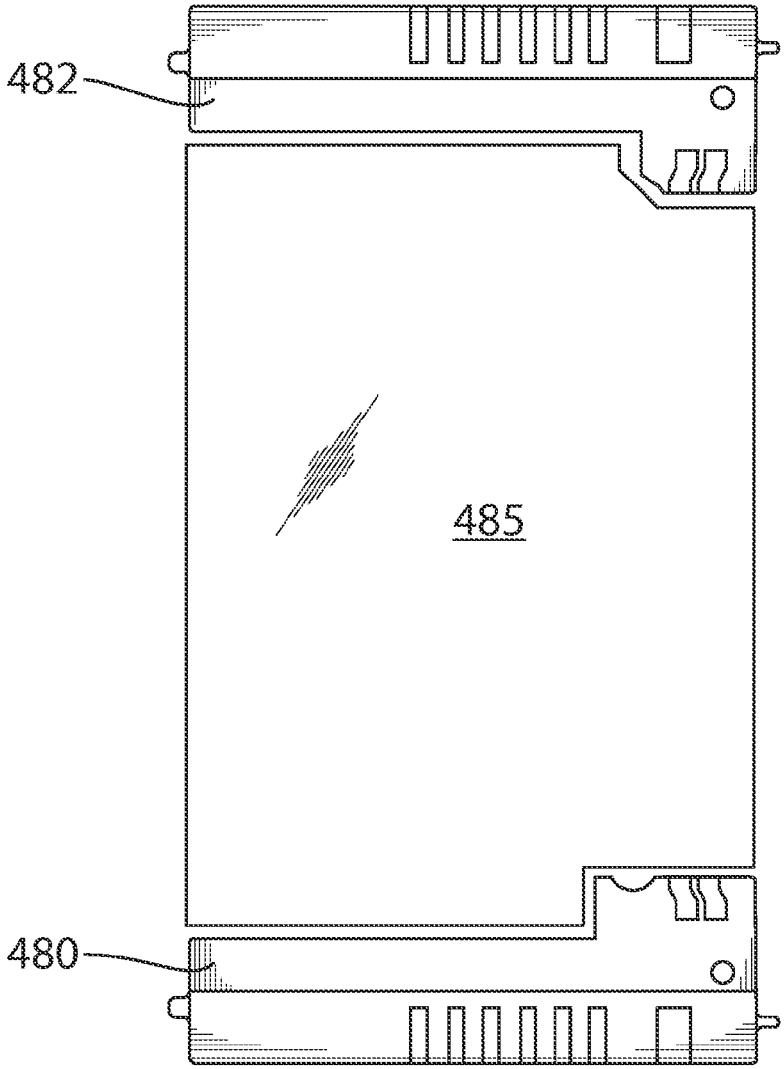

FIG. 4C illustrates a front view of a version of the antennas 400 and 450 curved around and mounted on three-dimensional substrates 480 and 482, respectively. As illustrated, the antennas are separated by a distance 499 of about 58 mm, which is significantly less than one quarter of the operating wavelength at 800 MHz. A ground plane may be provided within the region 485 formed between the antennas 400 and 450. By curving or wrapping the antennas around the substrates, the width of the antenna, in this case in the direction perpendicular to the antenna's longest dimension, is reduced. FIG. 4D illustrates a rear view of the antennas illustrated in FIG. 4C. The antennas illustrated in FIGS. 4C and 4D may be substantially orthogonally polarized, for example by virtue of each of the antennas having a polarization substantially within a plane parallel to the illustrated view and substantially at 45 degrees from the direction 491 and 495 indicative of the longest side of the antennas 400 and 450, respectively.

Figure 5A:
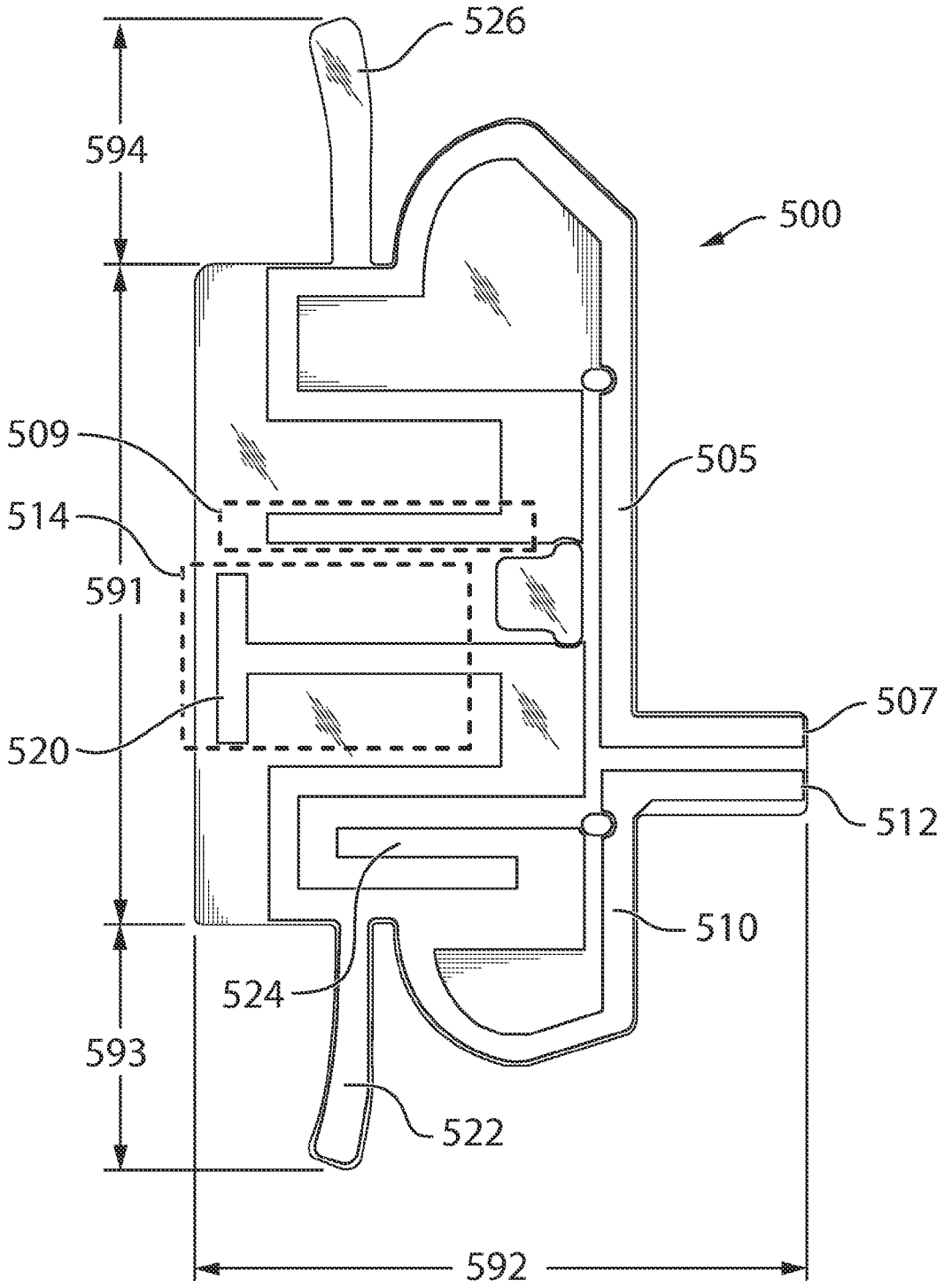
FIG. 5A illustrates the planar form of an antenna provided in accordance with an embodiment of the present invention.

FIG. 5A illustrates the planar form of an antenna 500 provided in accordance with embodiments of the invention. The antenna 500 may be provided in its planar configuration as electrically conductive elements printed on a flexible substrate, and subsequently the antenna 500 may be curved into a three-dimensional configuration. The antenna 500 comprises a first conductive element 505 and a second conductive element 510. The first and second conductive elements have first ends 507 and 512, respectively, which are proximate to each other so as to provide an antenna feedpoint. The first and second conductive elements also have second end portions 509 and 514, respectively, which are capacitively coupled to each other, for example to provide for electrical antenna lengthening.

Select further features of the antenna 500 will now be described. Starting from either endpoint, the first conductive element 505 and the second conductive element 510 generally diverge from each other. Each of the first conductive element 505 and the second conductive element 510 comprise meandering portions, which include the second end portions 509 and 514, respectively, as well as portions adjacent thereto. The meandering portions may provide for greater electrical antenna length within a given area limit.

Figure 5B:
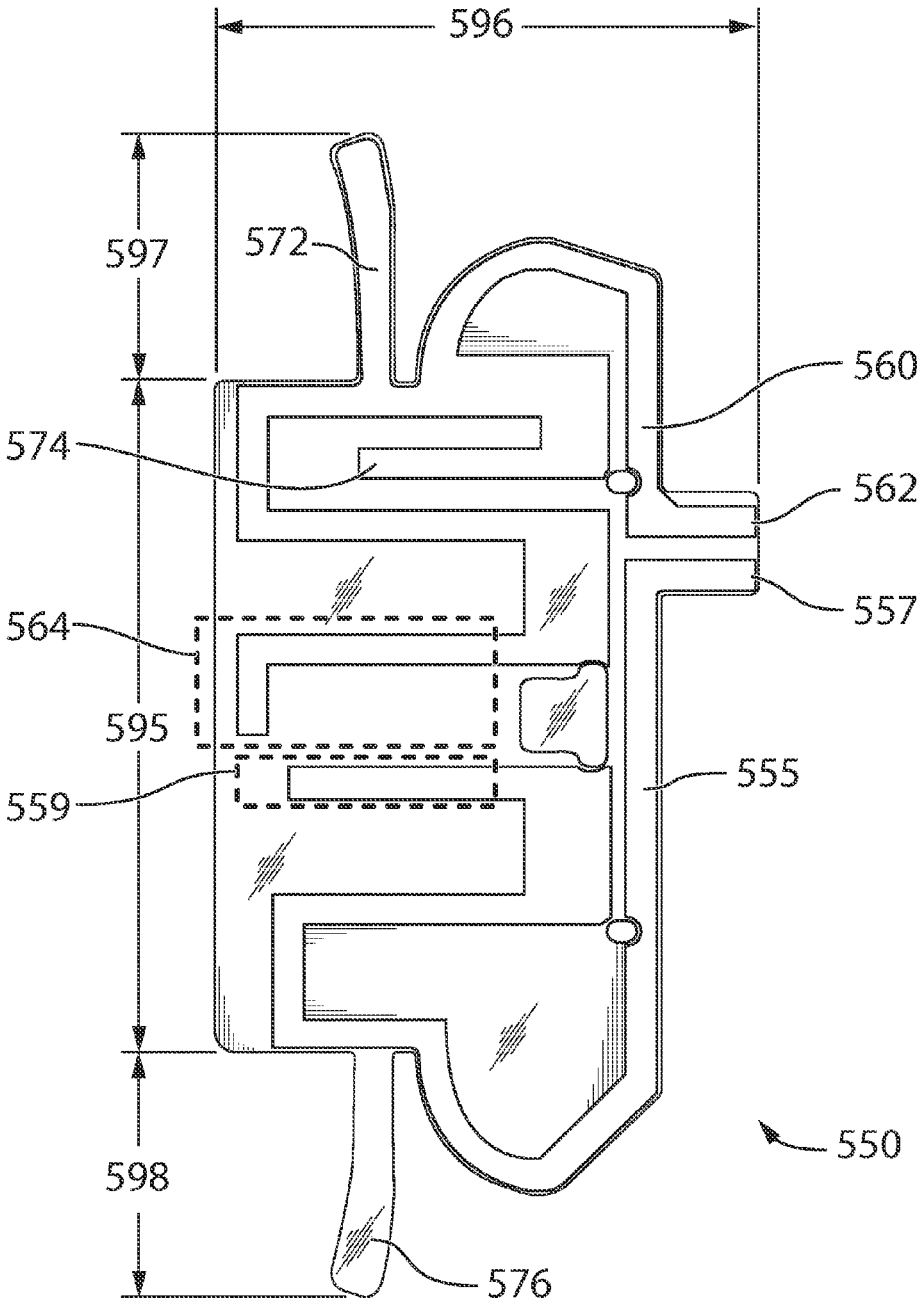
FIG. 5B illustrates the planar form of another antenna, which is a non-identical minor image of the antenna of FIG. 5A, in accordance with an embodiment of the present invention.

The antenna 500 further comprises branches or stubs 520, 522 and 524. These features may facilitate tuning of the antenna resonant frequency, bandwidth, or both, for example. The crossbar of the "T"-shaped element 520 may be regarded as a capacity hat. It has the effect of lowering the frequency of the antenna, making it more compact for the desired frequency. Adjusting the proximity of the branch of element 520 which is closest to the end portion 509 adjusts the coupling of the two parts of the Dipole. The other branch of element 520, which is an extra branch when compared with the antenna in FIG. 5B, gives the antenna 500 more bandwidth than the antenna 550. Thus, the antenna 500 may be better suited for both transmission and reception, whereas antenna 550 may be better suited to reception only. Components 522 and 524, in combination, form parts for the high band monopole antenna, that is the portions of the antenna 500 when operated in monopole mode. The basis of the high band monopole antenna is the second and third harmonics of the low band element. In one embodiment, when the low band is about 700 MHz and the high band is from about 1700 to 2700 MHz, components 522 and 524 may facilitate a re-tuning of the harmonic resonances upwards because the natural harmonics would be at 1400 and 2100 MHz. The whole shape of the antenna 500 in three dimensions, including proximities of the parts of the element coupling to each other, affects the overall antenna performance. Simulation and experimentation may be utilized to fine tune the design for a particular application. Element 526 is a non-conductive portion of substrate.

The antenna 500 illustrated in FIG. 5A may be configured as a main antenna for signal transmission and reception at about 700 MHz by dimensioning it as follows. Illustrated dimension 591 is about 42.80 mm, dimension 592 is about 39.50 mm, dimension 593 is about 15.88 mm, and dimension 594 is about 15.86 mm. Other features of the antenna, such as meander lengths and stubs, are illustrated to scale in proportion to these dimensions. It is noted that the antenna 500 is provided within a region having maximum dimension 591+593+594=74.54 mm which is less than one quarter of the operating wavelength at 700 MHz, (i.e. 74.54 mm is less than 107 mm).

FIG. 5B illustrates the planar form of an antenna 550 provided in accordance with embodiments of the invention, which may subsequently be curved into a three-dimensional configuration. The antenna 550 comprises a first conductive element 555 and a second conductive element 560. The first and second conductive elements have first ends 557 and 562, respectively, which are proximate to each other so as to provide an antenna feedpoint. The first and second conductive elements also have second end portions 559 and 564, respectively, which are capacitively coupled to each other.

Starting from either endpoint, the first conductive element 555 and the second conductive element 560 generally diverge from each other. Each of the first conductive element 555 and the second conductive element 560 comprise meandering portions, which include the second end portions 559 and 564, respectively, as well as portions adjacent thereto. The antenna 550 further comprises branches or stubs 572 and 574. Element 576 is an optional, non-conductive portion of substrate.

The antenna 550 illustrated in FIG. 5B may be configured as a diversity antenna for signal reception in cooperation with the antenna 500 at about 700 MHz by dimensioning it as follows. Illustrated dimension 595 is about 42.80 mm, dimension 596 is about 34.52 mm, dimension 597 is about 15.88 mm, and dimension 598 is about 15.89 mm. Other features of the antenna, such as meander lengths and stubs, are illustrated to scale in proportion to these dimensions. The antenna 550 is a non-identical mirror image of the antenna 500.

Figure 5C:
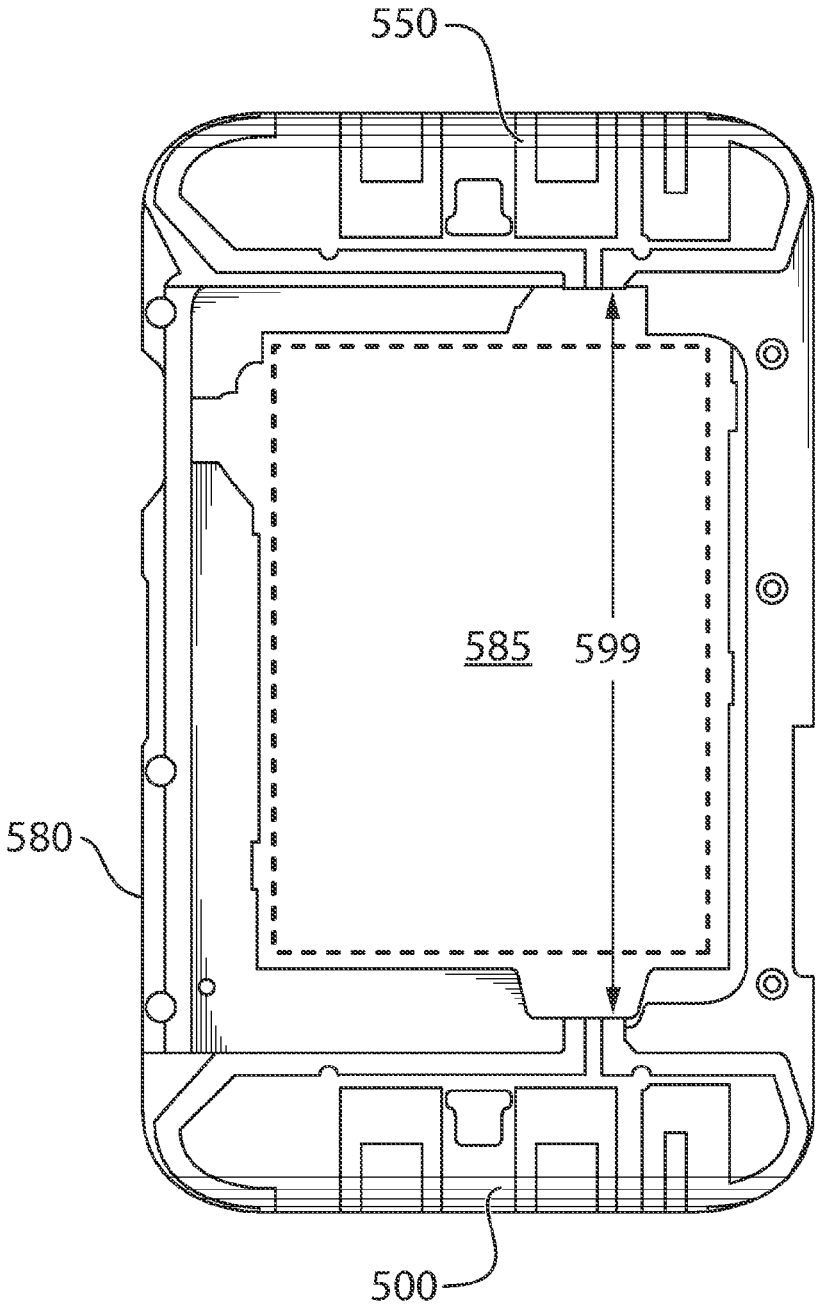
FIGS. 5C and 5D illustrate the antennas of FIGS. 5A and 5B spaced apart and mounted on a curved surface, in accordance with an embodiment of the present invention.
Figure 5D:
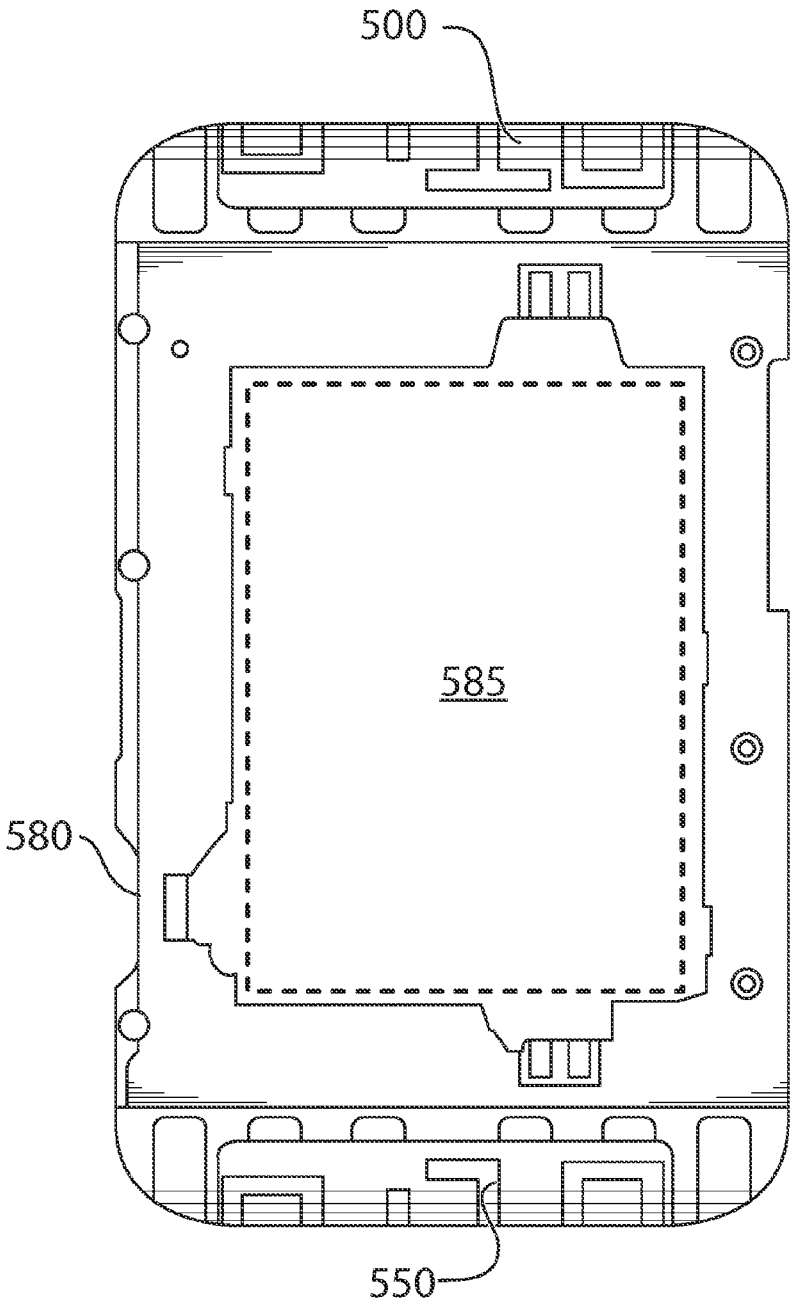

FIG. 5C illustrates a front view of a version of the antennas 500 and 550 curved around and mounted on a three-dimensional substrate 580. As illustrated, the antennas are separated by a distance 599 of about 72 mm, which is significantly less than one quarter of the operating wavelength at 700 MHz. A ground plane may be provided within the region 585 formed between the antennas 500 and 550. The proximity of the ground plane to the antenna may affect the low band polarization. The offset, non-centered feed of the dipoles may also cause some of the polarization shift to 45 degrees from the antenna axis. By curving or wrapping the antennas around the substrates, the width of the antenna, in this case in the direction perpendicular to the antenna's longest dimension, is reduced. FIG. 5D illustrates a rear view of the antennas illustrated in FIG. 5C. The antennas illustrated in FIGS. 5C and 5D may be substantially orthogonally polarized, for example by virtue of each of the antennas having a polarization substantially within a plane parallel to the illustrated view and substantially at 45 degrees from the direction 591+593+594 and 595+597+598 indicative of the longest side of the antennas 500 and 550, respectively.

Figure 6A:
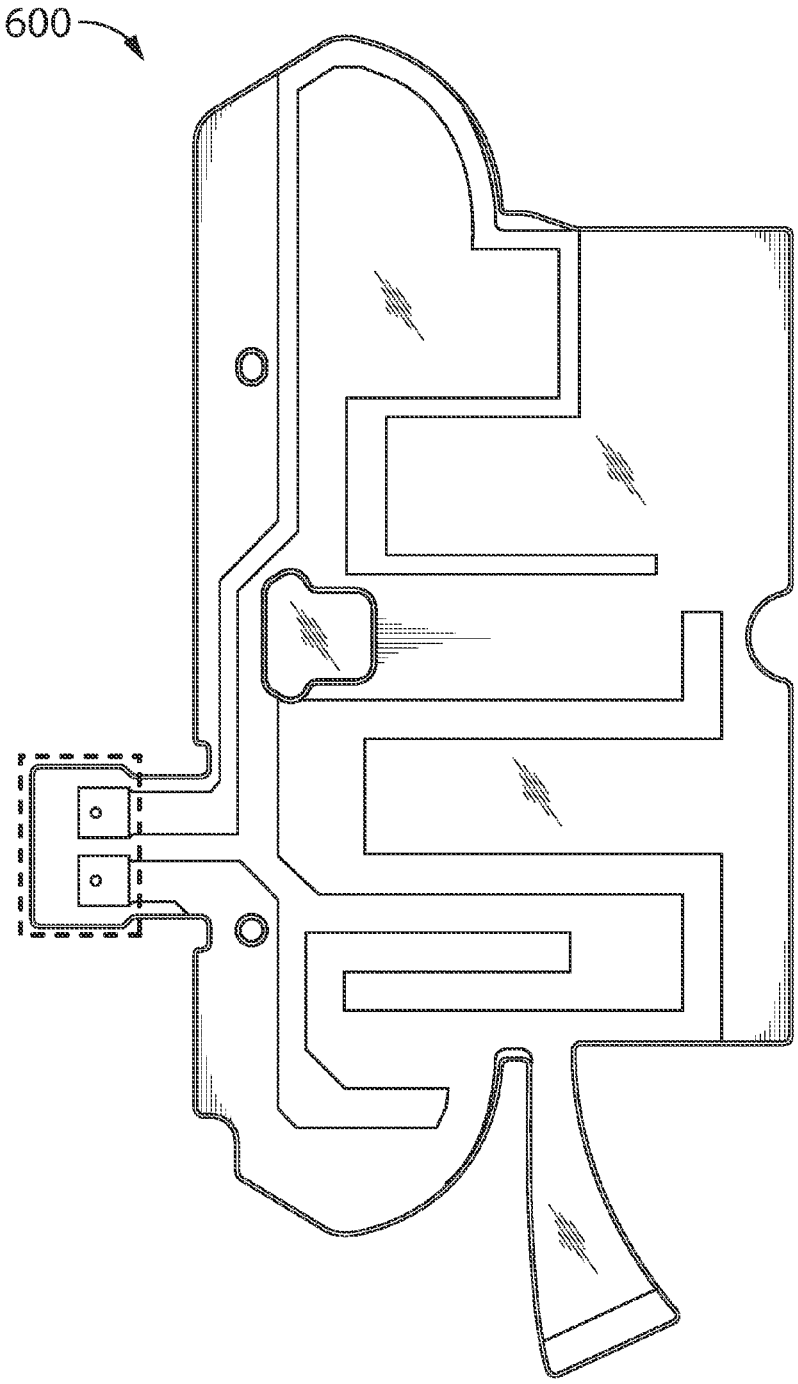
FIGS. 6A and 6B illustrate planar forms of a pair of other antennas provided in accordance with an embodiment of the present invention.
Figure 6B:
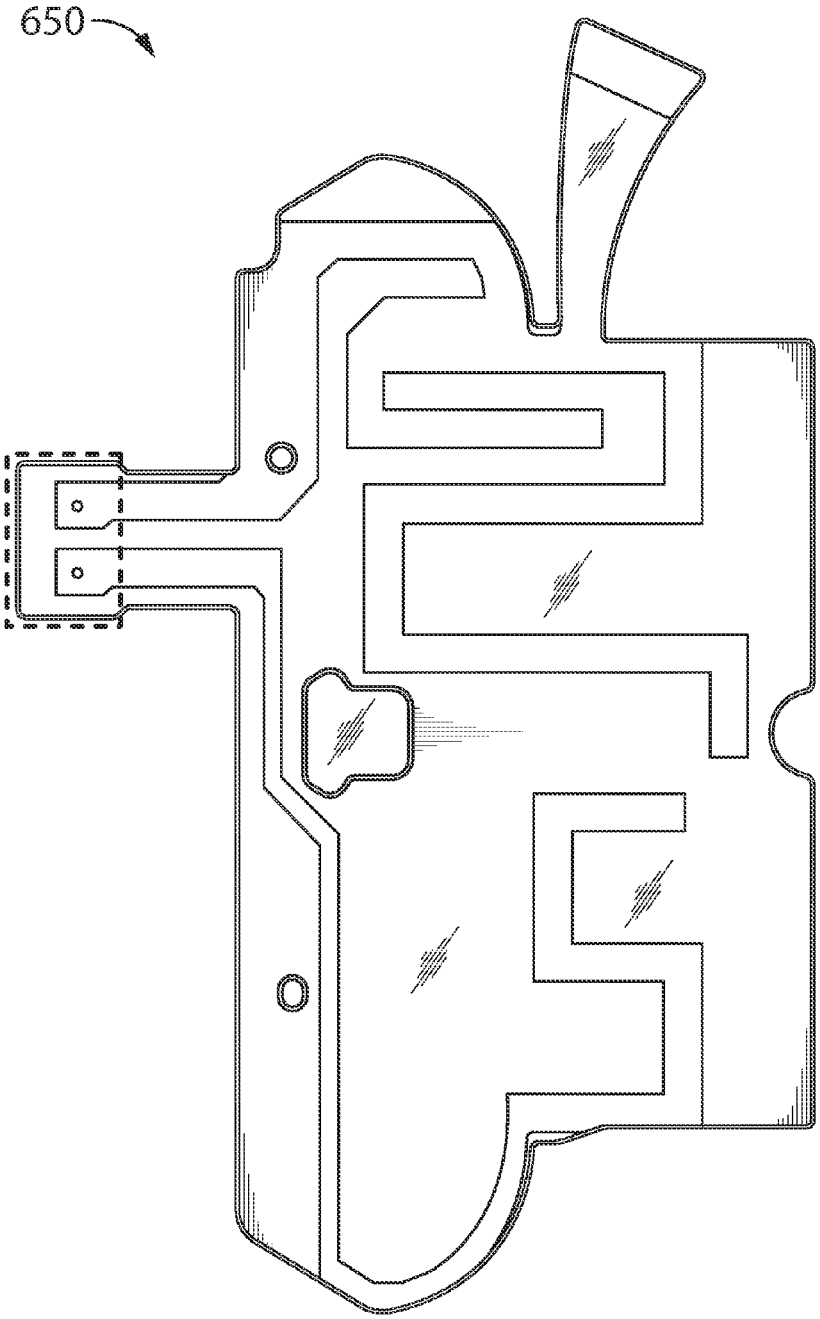

FIGS. 6A and 6B illustrate planar forms of two alternative antennas 600 and 650 provided in accordance with embodiments of the present invention. In some embodiments, the two antennas 600 and 650 may be used together, with antenna 600 operating as a main antenna used for transmission and reception, and antenna 650 operating as a diversity antenna for reception only. The two antennas 600 and 650 are non-identical mirror images of each other and may be provided on a flexible substrate for application to a curved surface, similarly to the antennas 500 and 550 and also with similar polarizations. The overall shape, operation and general features of the two antennas 600 and 650 are similar to those of antenna 500, except that certain feature lengths, widths, placements, and conductor widths, have been varied. In one embodiment, the illustrations of antennas 600 and 650 represent an accurate scaled representation. However, it will be appreciated that the antenna size and shape can be varied to fit a given application. It is noted that conductor widths may be varied in order to affect antenna operating characteristics.

In some embodiments, the antennas 600 and 650 represent varied or "fine-tuned" versions of the antennas 500 and 550, respectively. In one embodiment, the antennas 600 and 650 may exhibit reduced undesired interaction with the circuitry and/or the battery of the mobile device, relative to the antennas 500 and 550. For example, one or more elements in the antennas 600 and 650 may be regarded has having been modified, made thinner, and moved further away from the mobile device circuitry in order to reduce noise coupling into the antennas, relative to the antennas 500 and 550. In general, filtering may also be applied at the antenna feed points to further reduce noise coupling.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

I claim:

1. An antenna operable in a monopole mode and a dipole mode comprising:

first and second conductive elements, each of the conductive elements haying first and second end portions;

an antenna feedpoint operatively coupled to the first end portion of the first conductive element; and a ground operatively coupled to the first end portion of the second conductive element;

wherein the first end portions of the first and second conductive elements are substantially proximate to one another for a first length in which the first end portion of the first conductive element electromagnetically couples with the first end portion of the second conductive element, and wherein the first and second conductive elements diverge from each other following the first length, and wherein the first and second conductive elements converge toward the second end portions to form a capacitive gap, wherein the second end portions are proximate to one another for a second length less than the first length, and wherein, when the antenna is operated at a first, relatively low operating frequency, the antenna is operable in a monopole mode in which the second conductive element operates as a counterpoise for the first conductive element, and, when the antenna is operated at a second, relatively high operating frequency, the antenna is operable in a dipole mode in which the first conductive element couples the antenna feedpoint to the second conductive element.

2. The antenna according to claim 1, wherein the first conductive element further comprises a branched section providing a third end of the first conductive element.

3. The antenna according to claim 1, wherein the antenna is operable in a monopole mode and a folded dipole mode, wherein, in the monopole mode, at least a portion of the first element operates as an active monopole element and the second element operates as a passive monopole element, and wherein, in the folded dipole mode, at least a portion of the first element operates as a first active dipole element and the second element operates as a second active dipole element.

4. The antenna according to claim 1, wherein the antenna is provided within a region having a maximum dimension less than or equal to one quarter of an operating wavelength.

5. The antenna according to claim 1, wherein the antenna is operatively coupled to a ground plane, and wherein the feedpoint is located proximate to a corner of the ground plane.

6. The antenna according to claim 5, wherein the ground plane has a maximum dimension less than or equal to one quarter of an operating wavelength.

7. The antenna according to claim 6, wherein the maximum dimension is substantially less than one quarter of the operating wavelength.

8. A multi-antenna system comprising a pair of the antennas according to claim 1, the pair oriented as mirror images of each other with respect to a predetermined axis of symmetry.

9. The multi-antenna system according to claim 8, wherein the mirror images are non-identical mirror images.

10. The multi-antenna system according to claim 8, wherein each of the pair of antennas comprise a polarization substantially at 45 degrees relative to the axis of symmetry, the polarizations of the pair of antennas further being substantially orthogonal to each other.

11. The multi-antenna system according to claim 8, wherein each of the pair of antennas are operatively coupled to a common ground plane, and wherein the feedpoints of each of the pair of antennas are located proximate to opposite corners of the ground plane.

12. The multi-antenna system according to claim 11, wherein the opposite corners of the ground plane are separated by a distance less than or equal to one quarter of an operating wavelength.

13. The multi-antenna system according to claim 11, wherein each of the pair of antennas is operable in a monopole mode and a dipole mode, wherein the pair of antennas have polarizations substantially orthogonal to each other when operated in the dipole mode, thereby facilitating an envelope correlation coefficient of about 0.1 in a predetermined band about an operating frequency of the pair of antennas.

14. The multi-antenna system according to claim 13, wherein the pair of antennas are substantially isolated from each other when operating in either the monopole mode or the dipole mode.

15. A method of providing one or more antennas operable in a monopole mode and a dipole mode, the method comprising:

providing each of the one or more antennas as a printed circuit on a flexible substrate, each of the one or more antennas comprising:

(a) first and second conductive elements, each of the conductive elements having first and second end portions;

(b) an antenna feedpoint operatively coupled to the first end portion of the first conductive element: end (c) a ground operatively coupled to the first end portion of the second conductive element, wherein the first end portions of the first and second conductive elements are substantially proximate to one another for a first length in which the first end portion of the first conductive element electromagnetically couples with the first end portion of the second conductive element, and wherein the first and second conductive elements diverge from each other following the first length, and wherein the first and second conductive elements converge toward the second end portions to form a capacitive gap, wherein the second end portions are proximate to one another for a second length less than the first length, and wherein, when the antenna is operated at a first, relatively low operating frequency, the antenna is operable in a monopole mode in which the second conductive element operates as a counterpoise for the first conductive element, and, when the antenna is operated at second, relatively high operating frequency, the antenna is operable in a dipole mode in which the first conductive element couples the antenna feedpoint to the second conductive element; and mounting each of the one or more antennas onto a curved surface.

* * * * *

UNITED STATES PATENT AND TRADEMARK OFFICE

CERTIFICATE OF CORRECTION

PATENT NO. : 8,952,859 B2
APPLICATION NO. : 13/536408
DATED : February 10, 2015
INVENTOR(S) : Tan It is certified that error appears in the above-identified patent and that said Letters Patent is hereby corrected as shown below:

IN THE CLAIMS

CLAIM 1, Line 4 — Replace "haying" with "having"
Col. 18, Line 12

CLAIM 15, Line 10 — Replace "end" with "and"
Col. 20, Line 4

Signed and Sealed this
Twelfth Day of May, 2015

Michelle K. Lee

Michelle K. Lee
*Director of the United States Patent and Trademark Office*